United States Patent [19]

Rosen

[11] 4,447,920

[45] May 15, 1984

[54] CONVERTIBLE COUCH

[76] Inventor: Louis M. Rosen, 7 E. 14th St., New York, N.Y. 10003

[21] Appl. No.: 288,145

[22] Filed: Jul. 29, 1981

[51] Int. Cl.[3] ..... A47C 17/00

[52] U.S. Cl. ..... 5/12 R; 5/59 R; 297/383

[58] Field of Search ..... 5/12 R, 18 R, 37 R, 5/47, 39, 59 R, 52; 297/383

[56] References Cited

U.S. PATENT DOCUMENTS

| | | | |
|---|---|---|---|
| 365,619 | 6/1887 | Miller | 5/39 |
| 2,071,155 | 2/1937 | Alexander | 5/59 R |
| 2,368,938 | 2/1945 | McKay | 5/59 R |
| 2,579,921 | 12/1951 | Gibbs | 5/18 R |
| 2,957,185 | 10/1960 | Barrett | 5/59 R |
| 3,138,804 | 6/1964 | Bendell | 5/18 R |
| 3,319,269 | 5/1967 | Maddox | 5/12 R |
| 3,328,810 | 7/1967 | Berman | 5/12 R |
| 3,813,709 | 6/1974 | Friedman | 5/12 R |
| 3,855,646 | 12/1974 | Glickman | 297/383 |

FOREIGN PATENT DOCUMENTS

| | | | |
|---|---|---|---|
| 212518 | 12/1960 | Austria | 5/37 R |

*Primary Examiner*—Alexander Grosz
*Assistant Examiner*—Michael F. Trettel
*Attorney, Agent, or Firm*—Kenyon & Kenyon

[57] ABSTRACT

A convertible couch of a generally conventional size which may be readily converted into a single or twin bed assembly. Rollers are provided beneath the extending arm members of the back couch portion, the rollers being engaged with rail members disposed therebeneath on the horizontal cushion section to facilitate rolling of the back support member with respect to the lower cushion section. A locking latch is provided at the forward end of the arm members to lock the respective members in the desired position.

5 Claims, 5 Drawing Figures

CONVERTIBLE COUCH

BACKGROUND OF THE INVENTION

This invention relates generally to a convertible couch and in particular to one which is easily convertible to a bed assembly.

Because of space constraints, it is often necessary to combine the functions of two items of furniture. This has caused a wide gain in the popularity of the convertible couch or sofa. Such assemblies are provided in the form of a couch or sofa during daytime hours and by certain manipulations can be converted to a bed for sleeping purposes. While such convertible couch assemblies are heretofore known they have generally been provided with complex mechanisms which are often times difficult to operate. Furthermore, the complexity of such mechanisms has lead to increased expense and weight which have become associated with convertible couch assemblies. By the means disclosed herein, such disadvantages of the prior art are overcome.

SUMMARY OF THE INVENTION

Briefly stated, the convertible couch herein is readily convertible from a conventional couch to a bed assembly and includes a horizontal rectangular cushion member which forms the seating and lying surface. The cushion member is supported on four legs and is in cooperative engagement with an upright back member. A forwardly extending arm member is disposed at each end of the back member, the arm members being of a length which is shorter than the width of the horizontal cushion member. A guide rail is disposed at each end of the cushion member and extends generally for the length thereof. Roller means are disposed at each end of the couch assembly for engagement with the respective guide rail to facilitate rolling of the upright back member and extending arm with respect to the horizontal cushion member. In this manner the rearward rolling of the upright member enables the couch to be converted to a bed assembly. A latching means is provided for securing the upright member to the horizontal cushion member thus holding the respective members with respect to one another particularly in the couch position.

It is preferred that the guide rails are disposed at a slight rearward incline to facilitate easy rearward rolling into the bed position. The latching means is in the form of a pivotable latch member disposed on the forward portion of the extending arm and engagable with an upright post on the horizontal cushion member to support the upright back member in the most rearward position. Such extension member allows for the conversion to a larger size bed assembly. The extension support member may be provided in collapsible form to cause further space saving.

It is accordingly an object of this invention to provide a convertible couch assembly which is simple to operate and of a generally lightweight construction.

It is another object of this invention to provide a convertible couch assembly which functions without the need or use of complex mechanical mechanisms.

These and other objects, advantages and features of the invention will become more apparent from the following description taken in conjunction with the accompanying drawings.

DESCRIPTION OF THE PREFERRED EMBODIMENT

Figure 1:
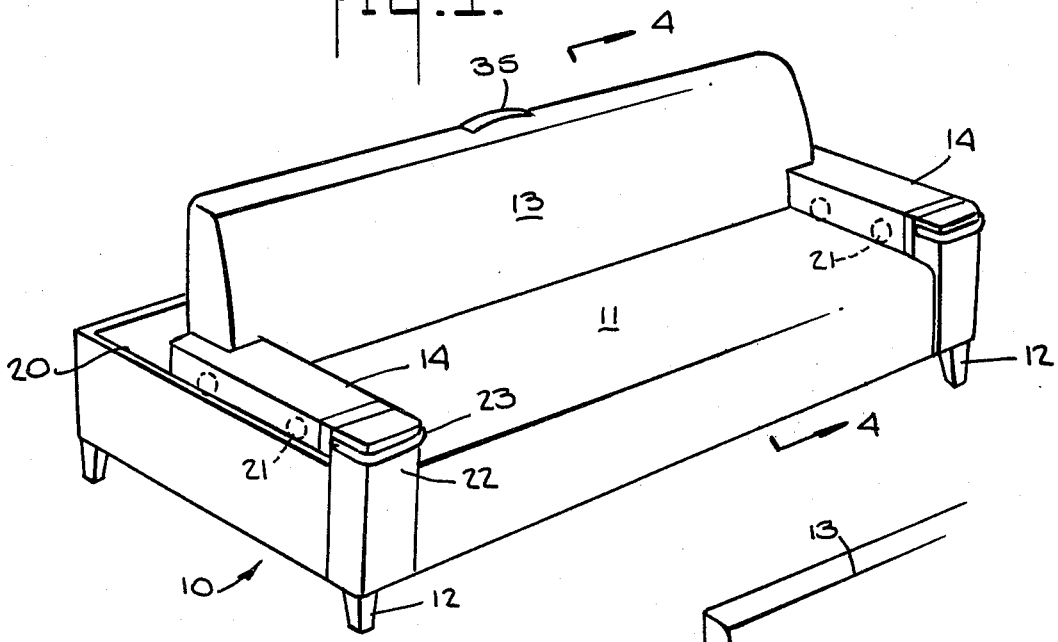
FIG. 1 is a perspective view of the convertible couch assembly of this invention.
Figure 2:
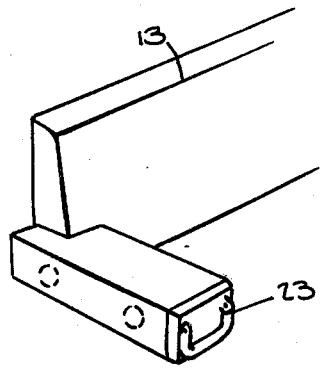
FIG. 2 is a partial perspective view of the end portion of the upright back portion of the couch assembly.

With reference to the drawings, the convertible couch 10 includes a horizontal rectangular cushion member 11 which forms generally the seating and lying surface. Legs 12 function to support cushion member 11. An upwardly inclined back support section 13 provides the rearward portion for the couch 10. Forwardly extending arms 14 are disposed at each end of the back section 13.

A rail member 20 is provided at each end of the cushion member 11 and extends generally for the length thereof. Roller members 21 are disposed on the forwardly extending arms 14 and are provided in engagement with rail member 20. In this manner, back support section 13 may be readily moved with respect to the horizontal cushion member 11. The rail members 20 are preferably disposed at a slight rearward incline to facilitate easy rearward rolling. It is noted further that the roller members 21 may be disposed within the rail member 20 and a suitable engaging surface provided on arm 14.

A post 22 is disposed at the forward corner positions of the horizontal cushion member 11. A pivotable latch member 23 is disposed at the forwardmost portion of arm 14. When pivoted in the downward position, latch 23 engages with post 22 to secure the arms and back support section 13 to the cushion member 11. When so engaged, the assembly functions as a conventional couch.

An extension support section is provided at the rearward side of cushion member 11. A horizontal support 30, which is preferably in the form of angle iron, is pivotally connected to inclined arm 31. When in the support position, arm 31 is locked into the upper portion of the rearward legs 12 by means of the hook type latch 32. In this manner, the back support section 13 may be moved sufficiently rearward to allow the entire cushion section 11 to be utilized as a bed.

Figure 4:
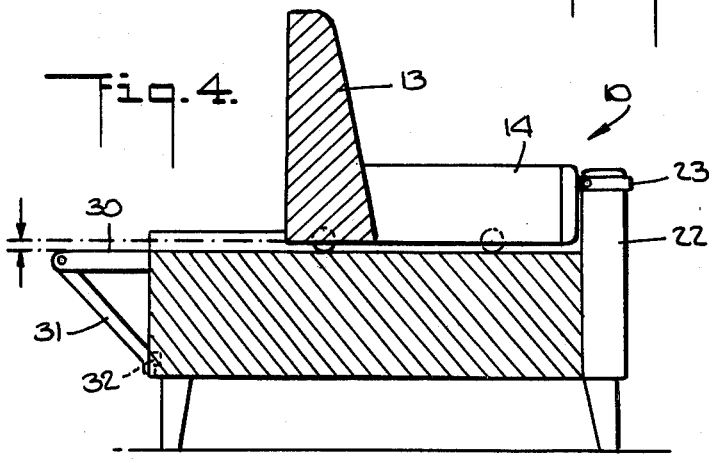
FIG. 4 is a side elevation view of the convertible couch assembly in the forward couch position.
Figure 3:
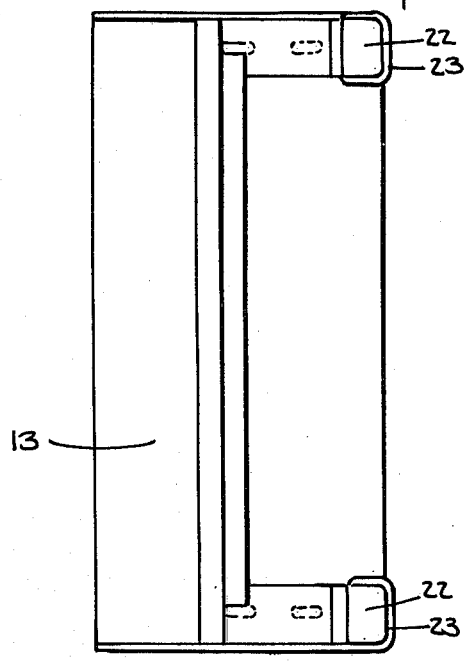
FIG. 3 is a plan view of the convertible couch assembly of this invention.
Figure 5:
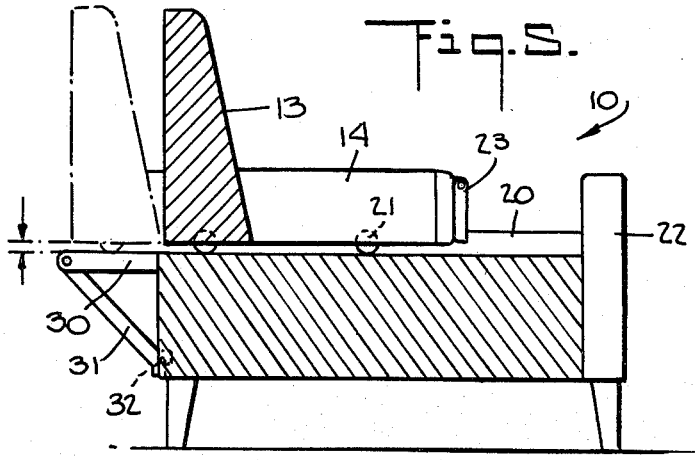
FIG. 5 is a side elevation view of the convertible couch assembly in the rearward or bed position.

Further features of the convertible couch 10 are in the strap member 35 to assist in rolling the back support 13 into the desired position. It is further noted with particular reference to FIG. 4 that ample storage space is provided behind the back support section 13 for stroage of blankets, pillows and the like so they are readily available when the couch is to be converted to a bed assembly.

Thus there has been described a convertible couch assembly which may be manufactured in a lightweight construction and without the need for any complex mechanisms. The couch is further found simple to operate and provides for substantial space saving without any sacrifice in comfort.

Although the above description is directed to a preferred embodiment of the invention, it is noted that other variations and modifications will be apparent to those skilled in the art, and, therefore, may be made without departing from the spirit and scope of the present disclosure.

What is claimed is:

1. A convertible couch assembly adapted to be readily converted from a couch to a bed assembly which comprises a generally horizontal rectangular cushion member which remains generally horizontal during conversion from said couch to said bed assembly and which is suitably supported on stationary legs, a generally upright back member forming a back support section of the couch which remains generally upright during conversion from said couch to said bed assembly, an arm rest attached to each end of said back member and extending forwardly thereof, said arm rest being of a length shorter than the width of said horizontal cushion member, a guide rail disposed at each end of the upper surface of said cushion member and extending generally for the length thereof, roller means disposed at each end of said couch assembly in the lower portion of said arm rest and upright back member for engagement with the respective guide rail to facilitate rolling of said upright back member together with said extending arm rest thereby enabling the conversion of said couch to a bed assembly and vice versa, and latch means for locking said back member with respect to said horizontal cushion member.

2. A convertible couch assembly as defined in claim 1 wherein said guide rails are inclined rearwardly with respect to the horizontal cushion member.

3. A convertible couch as defined in 1 which further includes an extending support member at the rearward side of said horizontal cushion member to support said upright back member in the most rearward position.

4. A convertible couch assembly adapted to be readily converted from a couch to a bed assembly which comprises a generally horizontal rectangular cushion member suitably supported on legs, a generally upright back member forming a back support section of the couch, an arm rest disposed at each end of said back member and extending forwardly thereof, said arm rest being of a length shorter than the width of said horizontal cushion member, a guide rail disposed at each end of said cushion member and extending generally for the length thereof, roller means disposed at each end of said couch assembly for engagement with the respective guide rail to facilitate rolling of said upright back member and extending arm thereby enabling the conversion of said couch to a bed assembly and vice versa, and a pivotable latch member attached to the forward portion of said arm and engagable with post means disposed on the forward end of said horizontal cushion member for locking said back member with respect to said horizontal cushion member.

5. A convertible couch as defined in claim 4 which further includes an extending support member at the rearward side of said horizontal cushion member to support said upright back member in the most rearward position.

* * * * *